US005698948A

United States Patent [19]

Caruso

[11] Patent Number: 5,698,948

[45] Date of Patent: Dec. 16, 1997

[54] METAL HALIDE LAMP WITH CERAMIC DISCHARGE VESSEL AND MAGNESIUM IN THE FILL TO IMPROVE LUMEN MAINTENANCE

[75] Inventor: Nancy J. Caruso, Turnhout, Belgium

[73] Assignee: U.S. Philips Corporation, New York, N.Y.

[21] Appl. No.: 418,232

[22] Filed: Apr. 6, 1995

[30] Foreign Application Priority Data

Apr. 13, 1994 [EP] European Pat. Off. ..... 94201008

[51] Int. Cl.[6] ..... H01J 61/30; H01J 61/82

[52] U.S. Cl. ..... 313/637; 313/638; 313/639; 313/640

[58] Field of Search ..... 313/637, 638, 313/639, 640, 641

[56] References Cited

U.S. PATENT DOCUMENTS

| | | | |
|---|---|---|---|
| 3,248,590 | 4/1966 | Schmidt | 313/637 X |
| 3,317,778 | 5/1967 | Timmersman et al. | 313/641 |
| 3,558,963 | 1/1971 | Henneman | 313/641 X |
| 3,761,758 | 9/1973 | Bamberg et al. | 313/640 |
| 3,840,767 | 10/1974 | Lake | 313/637 X |
| 3,867,665 | 2/1975 | Furmidge et al. | 313/485 |
| 3,898,504 | 8/1975 | Akutsu et al | 313/639 X |
| 4,769,576 | 9/1988 | Ohyama et al. | 313/638 |
| 5,394,059 | 2/1995 | Ohyama et al. | 313/639 |
| 5,451,838 | 9/1995 | Kawai | 313/641 X |

FOREIGN PATENT DOCUMENTS

| | | | |
|---|---|---|---|
| 0215524 | 3/1987 | European Pat. Off. | H01J 61/30 |

*Primary Examiner*—Ashok Patel
*Attorney, Agent, or Firm*—Walter M. Egbert

[57] ABSTRACT

A metal halide lamp includes a discharge vessel with a ceramic wall and a filling which comprises besides mercury and a halogen also Na, Tl and one or several of the elements from the group formed by Sc, Y and lanthanides. The filling also contains Mg to improve lumen maintenance.

6 Claims, 1 Drawing Sheet

METAL HALIDE LAMP WITH CERAMIC DISCHARGE VESSEL AND MAGNESIUM IN THE FILL TO IMPROVE LUMEN MAINTENANCE

BACKGROUND OF THE INVENTION

The invention relates to a metal halide lamp provided with a discharge vessel having a ceramic wall and a filling which comprises besides mercury and a halogen also Na, Tl and at least one of the elements from the group formed by Sc, Y and lanthanides.

A lamp of the kind mentioned in the opening paragraph is known from EP-A-0 215 524. The term ceramic material is understood to mean herein a refractory material such as monocrystalline metal oxide (for example sapphire), polycrystalline densely sintered metal oxide (for example polycrystalline densely sintered aluminium oxide, yttrium-aluminium garnet, or yttrium oxide) and polycrystalline non-oxidic material such as, for example, aluminium nitride. Such a material allows a high wall temperature up to 1500–1600K and is well capable of resisting chemical attacks by Na and halides. The addition of metal halides of Na, Tl and at least one of the elements from the group formed by Sc, Y and the lanthanides (Ln), more in particular in the form of metal iodides, to the ionizable filling of the lamp is an effective means of obtaining a lamp with a comparatively low colour temperature of the emitted light (approximately 2600–4000K), a comparatively high luminous efficacy, and a comparatively high colour rendering index Ra. The term lanthanides (Ln) is understood to mean herein a compound with at least one of the chemical elements 57 to 71. The lamp, which radiates light mainly in the visible region, is thus suitable in many circumstances, both for general lighting and for interior lighting. It is a disadvantage of the known lamp that the luminous efficacy shows a strong, continuous decrease during lamp life owing to discharge vessel wall blackening.

SUMMARY OF THE INVENTION

The invention has for its object to provide a measure whereby an improvement in the luminous efficacy is achieved over lamp life. According to the invention, a lamp of the kind mentioned in the opening paragraph is for this purpose characterized in that the filling also comprises Mg.

It was surprisingly found that the lamp according to the invention has a strongly improved behaviour as to the luminous efficacy during lamp life, this luminous efficacy remaining substantially constant over a few thousands of hours of operation. The Mg, which is present in the discharge vessel in the form of magnesium halide ($MgI_2$), does contribute to the spectrum of the lamp, but since this refers mainly to the wavelength region corresponding to green light, it is not found to be disadvantageous for the value of the luminous efficacy. Any undesirable influence of the added Mg on the colour temperature and the colour point of the light emitted by the lamp may be readily compensated for by an adaptation in the proportions of the other filling ingredients.

A possible explanation of the detrimental decrease in the luminous efficacy as found in practice is the occurrence of chemical reactions between the filling ingredients from the group formed by Sc, Y and Ln with spinel ($MgAl_2O_4$) which is present in the discharge vessel wall, so that the ingredients Sc, Y and Ln are withdrawn from the portion of the filling contributing to light generation and are deposited on the discharge vessel wall. It is found to be possible through the addition of Mg to influence the balance of one or several of the chemical reactions to such an extent that this balance is already achieved shortly after the beginning of lamp life, after which a further removal of the ingredients Sc, Y and Ln does not take place.

Based on the cause suggested above, it is advisable that the quantity of Mg of the $MgI_2$ present per unit surface area of the inner wall of the discharge vessel is at least 3 $\mu g/cm^2$.

Since the ingredients Sc, Y and Ln will usually be present in the form of halogen salts in excess quantities during lamp operation, the Mg will partly be dissolved as a halogen salt in the salt reservoir thus formed. Therefore, the quantity of Mg preferably is above 8 $\mu g/cm^2$.

BRIEF DESCRIPTION OF THE DRAWINGS

These and other aspects of the invention will be explained in more detail with reference to a drawing of an embodiment in which.

DESCRIPTION OF THE PREFERRED EMBODIMENTS

Figure 1:
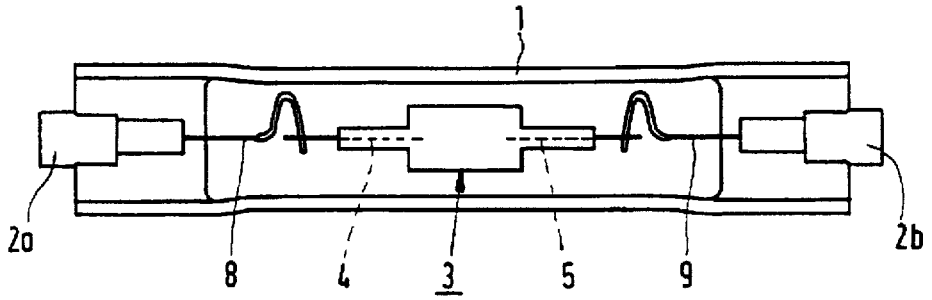
FIG. 1 shows a lamp according to the invention.

FIG. 1 shows a metal halide lamp provided with a discharge vessel 3 having a ceramic wall and a filling which comprises besides mercury and a halogen also Na, Tl and one or more of the elements from the group formed by Sc, Y and lanthanides. The filling also comprises Mg. The discharge vessel is enclosed by an outer bulb 1 which is provided with electrical connection contacts 2*a*, 2*b* at its two ends. The discharge vessel is provided with internal electrodes 4, 5 between which a discharge extends in the operational state of the lamp. Electrode 4 is connected to a first electrical connection contact 2*a* via a current conductor 8. Electrode 5 is connected to a second electrical connection contact 2*b* via a current conductor 9.

Figure 2:
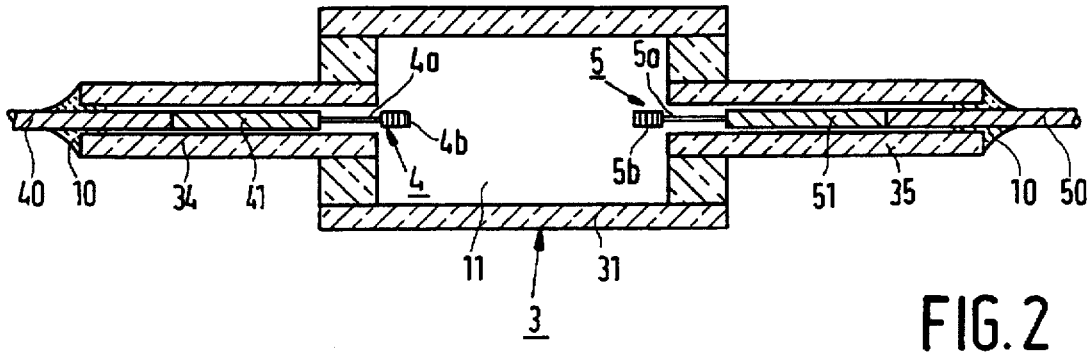
FIG. 2 is a cross-section of a discharge vessel of the lamp of FIG. 1, and FIG. 3 gives life test results of the lamp according to FIG. 1 and of a prior-art lamp.

The discharge vessel 3 is shown in detail in FIG. 2. The discharge vessel has a ceramic wall 31 which is provided at either end with a projecting ceramic plug 34, 35 for accommodating electric lead-throughs to the electrodes 4 and 5, respectively. The lead-throughs each comprise a halide-resistant portion 41, 51 made of, for example, Mo and a portion 40, 50, which is connected to a respective plug 34, 35 in a gastight manner by means of a ceramic glaze connection 10. The portions 40, 50 are made of a metal which corresponds very well to the projecting plugs as to its coefficient of expansion. For example, Nb is a highly suitable material. The portions 40, 50 are connected to the current conductors 8, 9, respectively, in a manner not shown.

Each electrode 4, 5 comprises an electrode rod 4*a*, 5*a* which is provided with a winding 4*b*, 5*b* at an end.

The discharge vessel 3 encloses a discharge space 11 in which the filling ingredients are present.

In a practical realisation of a lamp according to the invention, the discharge vessel is made from polycrystalline densely sintered aluminium oxide, as are the projecting plugs. The electrodes are made of tungsten and free from emitter. The rated power of the lamp is 70 W. The filling of the discharge vessel was 12 mg Hg and 5 mg of the metal halides NaI, TlI and $DyI_3$ in a weight ratio 52:23:25. In addition, the lamp comprised 0.5 mg $MgI_2$, and Ar as a starter gas.

The discharge vessel has an internal diameter of 9 mm and an internal length of 14 mm, resulting in a discharge vessel inner surface area of 5.4 $cm^2$. The quantity of Mg per unit surface area was thus 8.2 $\mu g/cm^2$.

The luminous efficacy of the lamp was measured in an endurance test.

For comparison purposes, the luminous efficacy during lamp life was also measured for a lamp according to the present art, identical to the lamp according to the invention, but without Mg in the filling.

Figure 3:
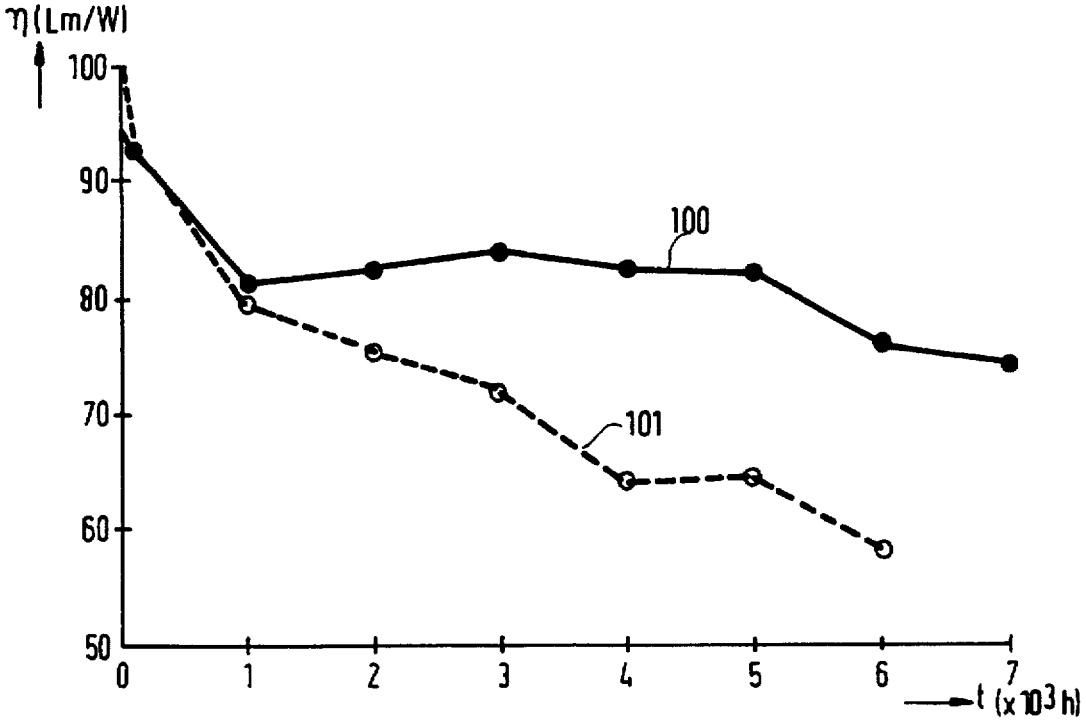

The results of the photometric measurements are given in FIG. 3. The operational time of the lamps is plotted on a horizontal axis in $10^3$ hours. The luminous efficacy in 1 m/W is plotted on a vertical axis. Curve 100 gives the result for the lamp according to the invention, curve 101 the result for the prior-art lamp.

It is evident that the luminous efficacy of the lamp according to the invention remains constant over several thousands of hours of operation, i.e. from 1000 h up to 5000 h. The luminous efficacy of the prior-art lamp shows a strong, continuous decrease throughout its life.

I claim:

1. A metal halide lamp including a discharge vessel having a ceramic wall and a filling comprising mercury, a halogen, Na, Tl and an element selected from the group consisting of Sc, Y and lanthanides, said discharge vessel producing mainly visible radiation during lamp operation, characterized in that the filling also comprises Mg.

2. A lamp as claimed in claim 1, characterized in that the quantity of Mg per unit surface area of the inner wall of the discharge vessel is at least 3 $\mu g/cm^2$.

3. A lamp as claimed in claim 2, characterized in that the quantity of Mg is at least 8 $\mu g/cm^2$.

4. A metal halide lamp, comprising:

a) an outer envelope sealed in a gas-tight-manner; and b) a discharge device within said outer envelope energizable for emitting light, said discharge device including a ceramic discharge vessel sealed in a gas-tight manner, a pair of discharge electrodes within said discharge vessel between which a discharge is maintained during lamp operation; and a discharge sustaining filling comprising mercury, a halogen, Na, Tl, an element selected from the group consisting of Sc, Y and lanthanides, and a quantity of Mg selected such that said lamp has a substantially constant luminous efficacy between about 1000 hours and at least about 5000 hours of lamp operation, said discharge device producing mainly visible radiation during lamp operation.

5. A lamp as claimed in claim 4, characterized in that the quantity of Mg per unit surface area of the inner wall of the discharge vessel is at least 3 $\mu g/cm^2$.

6. A lamp as claimed in claim 5, characterized in that the quantity of Mg is at least 8 $g/cm^2$.

* * * * *

UNITED STATES PATENT AND TRADEMARK OFFICE

CERTIFICATE OF CORRECTION

PATENT NO. : 5,698,948

DATED : December 16, 1997

INVENTOR(S) : Nancy Jean Caruso

It is certified that error appears in the above-identified patent and that said Letters Patent is hereby corrected as shown below:

Claim 6, line 2, change "8 g/cm$^2$" to --8 $\mu$g/cm$^2$--.

Signed and Sealed this

First Day of September, 1998

Bruce Lehman

*Attest:*

BRUCE LEHMAN

*Attesting Officer*

*Commissioner of Patents and Trademarks*